United States Patent [19]

Nakazumi

[11] 4,174,027

[45] Nov. 13, 1979

[54] EXHAUST GAS RECIRCULATION APPARATUS CONTROLLED BY CLUTCH, THROTTLE AND TIMER

[75] Inventor: Tadataka Nakazumi, Kure, Japan

[73] Assignee: Toyo Kogyo Co., Ltd., Japan

[21] Appl. No.: 846,494

[22] Filed: Oct. 27, 1977

[30] Foreign Application Priority Data

Nov. 5, 1976 [JP] Japan ..... 51/133441

[51] Int. Cl.[2] ..... F02M 25/06; F02B 33/00

[52] U.S. Cl. ..... 192/0.084; 74/860; 123/119 A

[58] Field of Search ..... 192/0.084, 0.048, 0.096

[56] References Cited

U.S. PATENT DOCUMENTS

| | | | |
|---|---|---|---|
| 3,783,847 | 1/1974 | Kolody | 74/860 |
| 4,008,697 | 2/1977 | Konno | 74/860 |
| 4,068,472 | 1/1978 | Takata et al. | 192/0.084 X |
| 4,073,202 | 2/1978 | Aoyama et al. | 74/860 |
| 4,120,214 | 10/1978 | Toda et al. | 74/859 |

*Primary Examiner*—Benjamin W. Wyche

*Attorney, Agent, or Firm*—Wenderoth, Lind & Ponack

[57] ABSTRACT

The engine has a duct connecting the gases in the exhaust gas crossover passage to the intake manifold and providing with a flow control valve for controlling the flow in the duct in such that said valve is moved to open by signals from both of a clutch-actuation detection device and a throttle valve-opening detection device and is kept opening by signal from a timer to be actuated by said two devices.

9 Claims, 3 Drawing Figures

EXHAUST GAS RECIRCULATION APPARATUS CONTROLLED BY CLUTCH, THROTTLE AND TIMER

Figure 1:
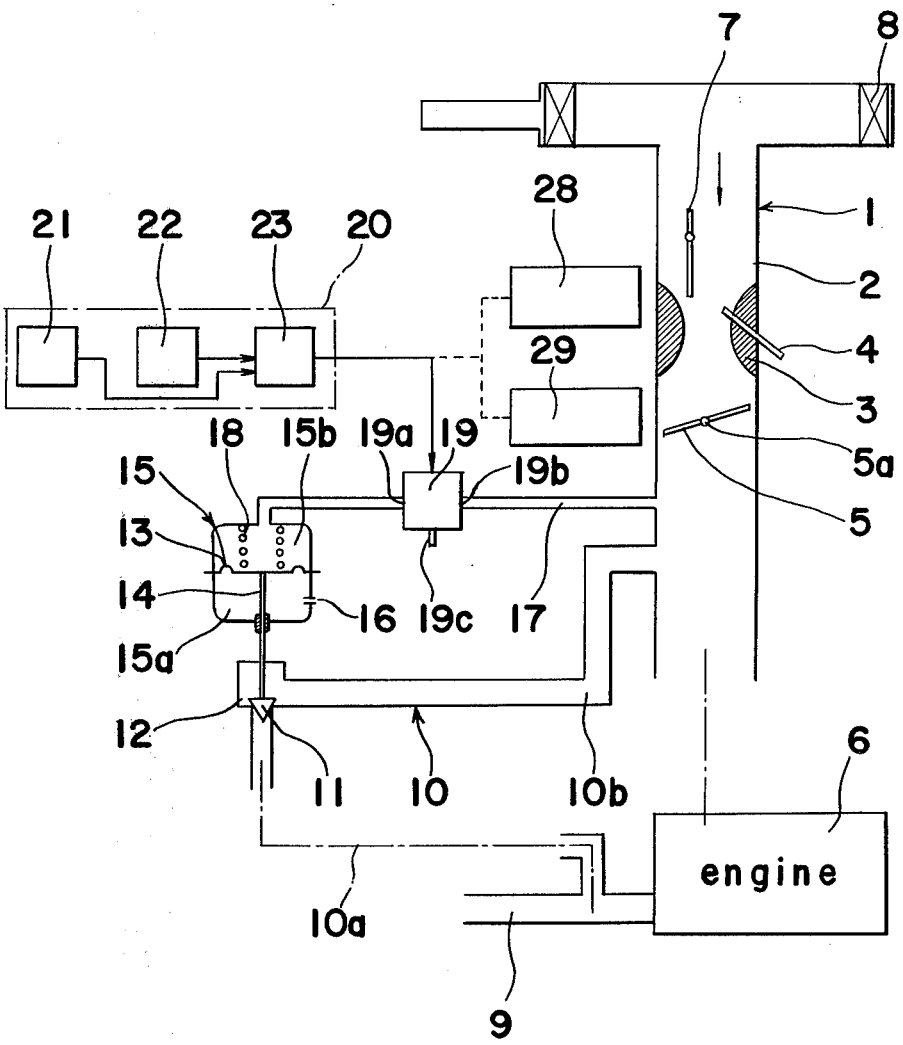

This invention related to an improvement of an exhaust gas recirculation apparatus for an internal combustion engine of an automotive vehicle for controlling the recirculation of exhaust gases back into the engine through the intake manifold in order to reduce $NO_x$ emission within the exhaust gases.

A known technique for reduction of emission of pollutants, particularly nitrogen oxides, in the exhaust gases of an internal combustion engine which are discharged to the atmosphere is to recycle a portion of the exhaust gases to a stage preceding the combustion stage, usually to the carburetor or the intake passage. For instance, U.S. Pat. No. 3,930,475 of John A. Lewis et al. patented on Jan. 6, 1976 discloses an exhaust gas recirculating system provided with a valve for opening and closing a duct containing exhaust gases for recirculation into an engine, the valve being moved to open the duct by a force that is determined by manifold vacuum level and is proportional to changes in manifold vacuum modulated by the carburetor throttle valve. From a point of view for an improvement of the conventional apparatuses in these system, it should be noted that the amount of $NO_x$ emission in the exhaust gases from the engine is a great deal of discharging during accelerating range of vehicle in comparison with that of normal cruising range thereof. In addition thereto, it is also to be noted that, when the vehicle is cruising at normal speed within the city and town, the vehicle is often brought into the acceleration range by operation of the shift-change for the transmission before the actuation of the accelerator pedal, and the clutch pedal for shift change is often times actuated to shift the one driving condition of engine into the other driving condition at intervals of several or several decades of seconds, thereby to cause to render the vehicle cruising at a certain constant speed to move or change into other accelerating or decelerating condition in a very short time.

Accordingly, it is an object of this invention to provide an exhaust gas recirculation apparatus that affords a practical control of the recirculation of exhaust gases back into the engine by detection of the actuation for the clutch pedal following opening of the throttle valve, and said recirculation of exhaust gases will terminate after expiring a predetermined time.

Another object of the invention to provide an exhaust gas recirculation apparatus which is simple in construction, accurate in functioning and is easily associated with a conventional carburetor.

In accomplishing these and other objects, there is provided according to the present invention an exhaust gas recirculation apparatus for an internal combustion engine provided with a transmission to be operated by a clutch and having a throttle valve controlling flow through a carburetor induction passage and a duct connecting the exhaust gases to the engine intake manifold with a flow control valve normally closing the duct to prevent recirculation and movable to an open position by a signal to be supplied from a control unit, said control unit comprising a device for detecting the actuation of said clutch, a device for detecting the opening of said throttle valve to be reached to the extent above a predetermined degree of opening and a timer to be actuated for a presetting period, and said flow control valve being moved to open by signals from both of said devices and kept opening by signal from said timer.

Figure 2:
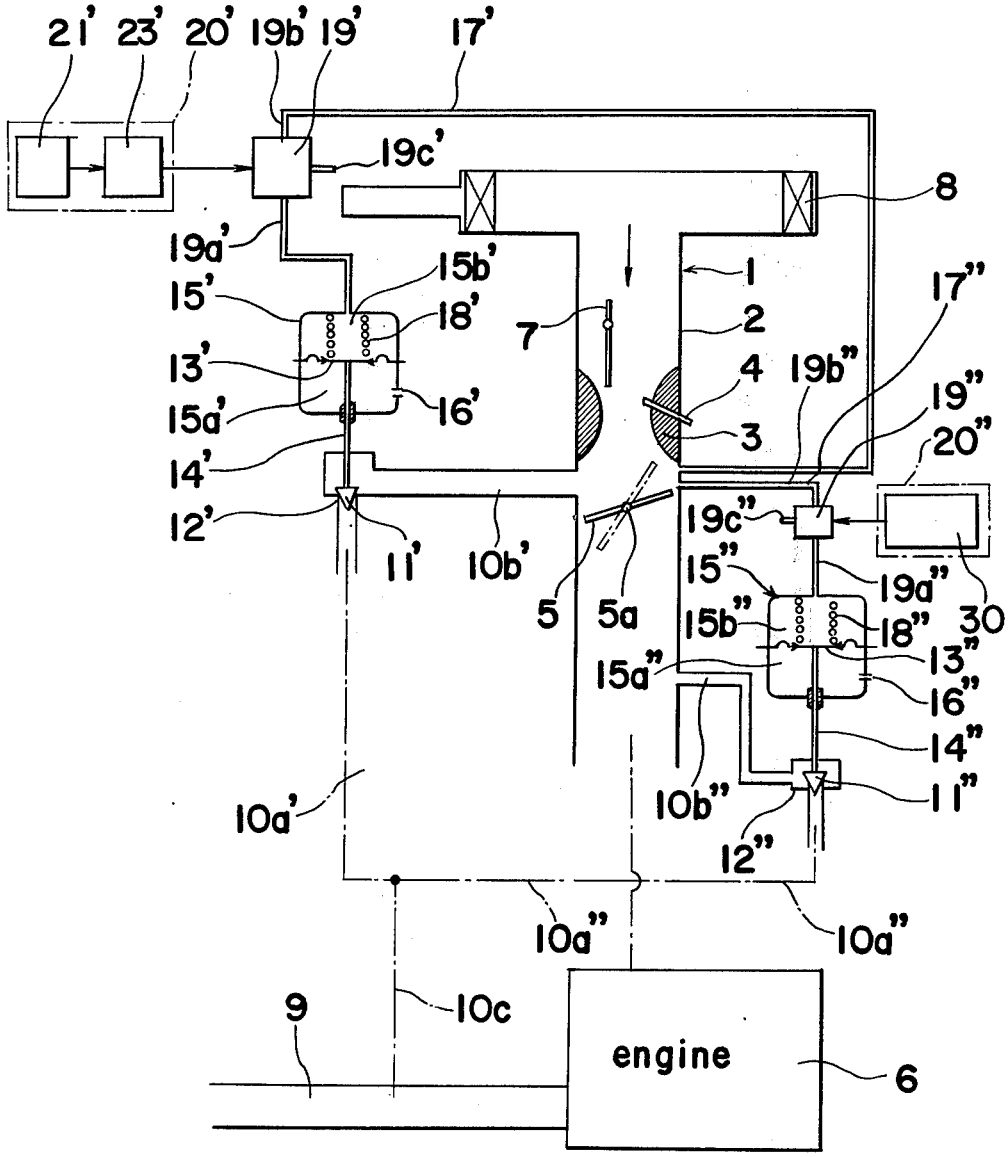
Figure 3:
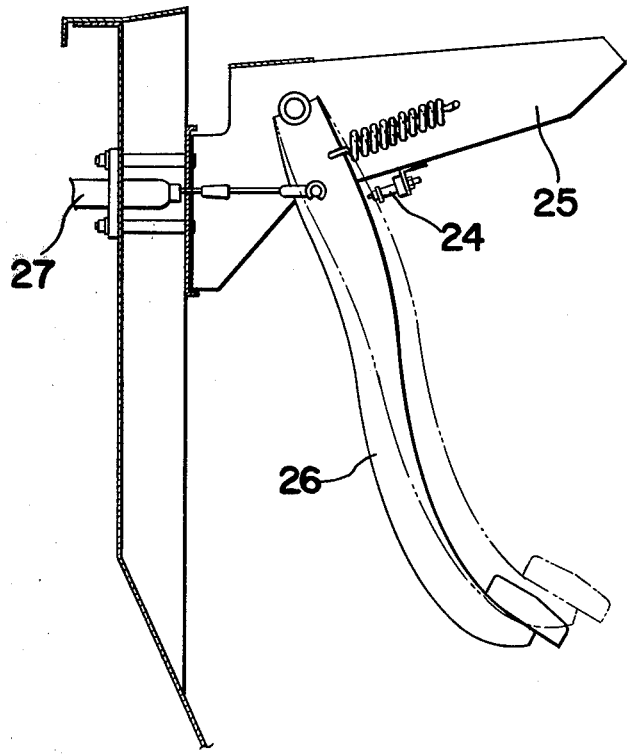

A better understanding of the invention may be had from the following full description thereof when read in reference to the attached drawings, in which like numbers refer to like parts, and FIG. 1 is a schematic cross-sectional view showing main features of an exhaust gas recirculation apparatus for an internal combustion engine according to a first embodiment of the invention;

FIG. 2 is a view similar to FIG. 1 and showing a second embodiment of the invention; and FIG. 3 is a side elevational view showing a portion of a clutch-actuation detecting device to be employed in the above embodiments of the invention.

Referring to FIG. 1, there is shown a portion of a carburetor 1 of a known downdraft type comprising an air intake circuit 2 which leads to a venturi section 3, a main nozzle 4 providing communication between a fuel float device not shown and the venturi section 3, through which the main supply of fuel is induced, and a throttle valve 5 downstream of the venturi section 3, i.e., on the opposite side of the venturi section 3 to the air intake circuit 2, and which produces an air-fuel mixture in a conventionally known manner and supplies the air-fuel mixture to be burned in one or more combustion chambers of an engine indicated schematically at 6. The carburetor 1 may include other conventionally known elements such as a choke valve 7 upstream of the venturi section 3, and an idle port and low speed port not shown. In terms of air flow into the carburetor 1, the air intake circuit 2 is suitably preceded by an air cleaner 8 comprising a filter, through which the fresh air from the outside is induced. Flow of air and fuel through the air intake circuit 2 is controlled by the operation, i.e., opening or closing of the throttle valve 5 which is fixed on a shaft **5*a*** rotatably mounted in the side wall of the carburetor body, and is connected to and actuated by an accelerator pedal not shown through an engine carburetor throttle linkage mechanism including a lever and engine throttle cable not shown.

Gases of combustion of the mixture are exhausted from the engine 6 through an exhaust pipe 9 and a portion thereof is taken off from the exhaust pipe 9 by a take-off line **10*a* branched from the exhaust pipe 9 and supplied by an intake line 10*b* having a delivery end which opens into a portion of carburetor 1 which is downstream of the throttle valve 5 and, in this embodiment, is upstream of an engine intake manifold also, said take-off line 10*a* and intake line 10*b* constituting an exhaust gas recirculation line 10 or an exhaust gas recirculation duct. Flow of exhaust gas along the recirculation line 10 may be throttled or completely stopped by a flow control valve 11 which may be seated on a valve seat 12 defined by wall portions of the recirculation line 10 and actuated to open within the range of an accelerating condition of the engine 6, and whose degree of opening is controlled by a diaphragm 13 through a rod 14 having one end attached to the flow control valve 11 and the opposite end connected to one side of the diaphragm 13 extending across and mounted to a diaphragm unit 15. The rod 14 of the flow control valve 11 projects sealingly through wall portions of the recirculation line 10 and the diaphragm unit 15 through rubber seals not shown. The diaphragm 13 defines on opposite sides in the diaphragm unit 15 a constant pressure chamber 15*a* and a negative pressure chamber 15*b*. The portion of the diaphragm unit 15 which is in part bounded by the side of the diaphragm 13 to which the rod 14 is connected is sealed or connected to a constant pressure source such as the atmosphere through an air bleed port 16 of the diaphragm unit 15 to constitute a constant pressure chamber 15***a*. The portion of the diaphragm unit 15 which is on the opposite side of the diaphragm to the constant pressure chamber 15*a* constitutes the negative pressure chamber 15*b* which is connected through a control fluid duct 17 to a negative pressure source, for example, a portion of the carburetor 1 which is downstream of the throttle valve 5, and, in this embodiment, is a middle portion between the throttle valve 5 and the delivery end of the intake line 10*b*. In the negative pressure chamber 15*b* there is provided a coil spring 18 which acts on the flow control valve 11 via the diaphragm 13 and rod 14 and constantly exerts a force to the flow control valve 11 on the valve seat 12 to block flow of exhaust gases in the recirculation line 10. It should be noted that the force of the coil spring 18 is chosen such that, when the vehicle is accelerated with the negative pressure in the negative pressure chamber 15*a* being lowered to a value not larger than a predetermined value in comparison with pressure of the constant pressure chamber 15*b*, the diaphragm 13 is upwardly biased to actuate and maintain the flow control valve 11 opening. The coil spring 18 normally would be a light spring, although it will be clear its force can be varied in order to vary operation of the diaphragm 13.

On the control fluid duct 17 there is provided a three-way solenoid-operated valve 19 having a solenoid to be actuated by a signal from a control unit 20 in a manner described below, and three ports, i.e., a pair of ports 19*a* and 19*b* provided to cut into a middle portion of the control fluid duct 17, one 19*a* connecting to the negative pressure chamber 15*b* and the other 19*b* connecting to the portion of the carburetor 1, and an air bleed port 19*c* connected to the atmosphere through an opening in the valve body. It should be noted that the three-way solenoid-operated valve 19 is operated by the actuation of the solenoid to change-over from the air bleed position to the EGR position and vice versa in such a manner that, during normal condition of vehicle, i.e., engine idle and cruising and wide-open throttle operations, the port 19*a* connected to the negative pressure chamber 15*b* is always connected to the air bleed port 19*c* in the air bleed position of the three-way solenoid-operated valve 19 with a result of providing essentially atmospheric pressure in the negative pressure chamber 15*b* and maintaining the flow-control valve 11 closing the recirculation line, while, during specific condition of vehicle, i.e., the engine accelerating range which is detected by the control unit 20 which supplies a signal to the solenoid to change-over the three-way solenoid-operated valve 19 from the air bleed position to the EGR position, the air bleed port 19*c* is closed and the port 19*a* connected to the negative pressure chamber is newly connected to the port 19*b* connected to the portion of the carburetor 1, resulting in that the negative pressure in the carburetor 1 is introduced into the negative pressure chamber 15*b* through the pair of ports 19*a*, 19*b* in the three-way solenoid-operated valve 19 and the control fluid duct 17. The control unit 20 for detecting the engine accelerating range comprises a device 21 for detecting the actuation of the clutch of a transmission not shown, for instance, the positioning of a clutch pedal to be operated by a driver, a device 22 for detecting the opening of the throttle valve 5, the degree of which is reached to the extent above a predetermined value, and a timer means 23 to be actuated for a presetting period, said pair of detecting means 21 and 22 being connected, for instance, through an AND gate not shown to the timer means 23 which is in turn connected to the solenoid of the three-way solenoid-operated valve 19. The clutch-actuation detecting device 21 is, for instance, constituted by a switch 24 which is provided on a frame 25 and actuated by the clutch pedal 26 pivoted on the frame 25 and connected to the transmission through a linkage mechanism 27 in such a manner that, when the clutch pedal 26 is rearwardly in the free position without the operation of the driver, the switch 24 is found opening, and, on the other hand, when the clutch pedal 26 is forwardly pushed by the driver to the operating position, the switch 24 is turned closing, as shown in FIG. 3. Also, the control unit 20 is suitably an electrical or electronic unit, which is not necessary positioned adjacent to the carburetor 1.

The exhaust gas recirculation apparatus of a first embodiment of the invention is constituted with the parts disclosed hereinabove, the operation of which will be explained hereinafter.

Still referring to FIG. 1, when the driver wishes to accelerate the vehicle during cruising at the normal speed in the city, it is necessary for the driver to actuate the clutch so as to change the shift of the transmission as an initial step, and, then, to push and keep an accelerator pedal forward to open the throttle valve 5 for several or scores seconds, the opening of which should be reached to the degree larger than a predetermined value. With these steps for the acceleration of the engine, the pair of detectig devices 21 and 22 in the control unit 20 are simultaneously actuated by the clutch and throttle valve 5 to supply signals thereof to the timer means 23 which is, in turn, actuated for a presetting period to supply the output signal to the solenoid of the three-way solenoid-operated valve 19. Upon receiving the signal from the timer means 23, the three-way solenoid-operated valve 19 is actuated by energizing of the solenoid to change-over from the air bleed position to the EGR position and maintained the EGR position thereof for the presetting period of the timer means 23, in such a manner that the air bleed port 19*c* is closed and the other ports 19*a* and 19*b* are connected to each other to alive the control fluid duct 17 through which the negative pressure is introduced from the carburetor 1 into the negative pressure chamber 15*b* of the diaphragm unit 15. If now the pressure difference between the negative pressure chamber 15*b* and constant pressure chamber 15*a* in the diaphragm unit 15 is reached to a level larger than the predetermined value where the difference pressure applied on the diaphragm 13 is sufficient to overcome the force of the coil spring 18, the diaphragm 13 is urged to move upwardly together with the rod 14 of the flow control valve 11 against the force of the coil spring 18, whereby the flow control valve 11 is rendered to move up and apart from the valve seat 12 to open the recirculation line 10, and a portion of the exhaust gases from the engine 6 will be supplied from the exhaust pipe 9 into the engine intake manifold through the recirculation line 10. Accordingly, the recirculation of the exhaust gases through the recirculation line 10 will occur substantially at the same time as the actuation of the accelerator pedal by the driver until the presetting period of the timer means 23 is terminated. Upon the termination of the presetting period of the timer means 23, the solenoid of the three-way solenoid-operated valve 19 is deenergized to return the three-way solenoid-operated valve 19 to its original position, i.e., air bleed position at once in such a manner that the port 19*b* connected to the portion of the carburetor 1 is closed and the port 19*a* connected to the negative pressure chamber 15*b* of the diaphragm unit 15 is connected to the air bleed port 19*c* with the result of introducing the atmospheric pressure into the negative pressure chamber 15*b*. The changing-over of the three-way solenoid-operated valve 19 to the air bleed position will cause again to equalize the pressures in both chambers 15*a* and 15*b* partitioned with the diaphragm 13 of the diaphragm unit 15, and, as a result thereof, the coil spring 18 will automatically move the rod 14 together with the flow control valve 11 which will again be seated on the valve sheet 12 to cut-out the recirculation line 10, whereby the recirculation of the exhaust gases is completely stopped by the closing of the flow control valve 11. Thus, no recirculation of exhaust gases will occur until the vacuum level again builds up in the diaphragm unit 15 by changing-over the three-way solenoid-operated valve 19. In other words, so far as the pair of detecting means 21 and 22 are not actuated successively in a certain period in order of supplying signals from the clutch-actuation detecting device 21 and the throttle valve-opening detecting device 22 to the solenoid of the three-way solenoid-operated valve 19, the control fluid duct 17 is cut-off by the three-way solenoid-operated valve 19 without introducing negative pressure of the carburetor 1 into the negative pressure chamber 15*b* of the diaphragm unit 15, whereby the flow control valve 11 is closed and impedes of the recirculation of the exhaust gases through the recirculation line 10. When the vehicle has reached its cruising condition, since either one or both of the pair of the detecting means 21 and 22 are not actuated to change-over the three-way solenoid-operated valve 19, the diaphragm unit 15 is always kept in non-operation condition and the flow control valve 11 is maintained closing to cut-off the recirculation of exhaust gases.

In addition to the arrangement of the first embodiment of the invention, there are further provided with an air-fuel-ratio adjusting device 28 and an ignition-timing adjustment device 29 both connected to the timer means 23 in parallel to the three-way solenoid-operated valve 19, as shown in FIG. 1. When the timer means 23 is actuated to supply the output signal to the pair of the above mentioned devices and the valve 19 at the same time under the accelerating condition of the engine, the flow control valve 11 will open and recirculate the exhaust gases by changing-over of the three-way solenoid-operated valve 19 as mentioned hereinabove, while the air-fuel-ratio adjusting device is operated to control the air-fuel-ratio in the carburetor 1 for producing a condition being rich in fuel in comparison with the amount of air by means of, for example, ejecting fuel from the main nozzle 4 to the venturi section 3, and the ignition-timing adjustment device is automatically adjusted the ignition point of an ignition means of the engine to a proper condition suitable for complete combustion of fuel in the engine or reduction of $NO_x$ emission in the exhaust pipe. The ignition-timing adjustment device is controlled such that, when the $NO_x$ emission is effectively reduced by the recirculation of exhaust gases, the ignition-timing will be advanced to improve the combustion of the engine, and when the $NO_x$ emission is increased in the exhaust pipe, the ignition-timing will be delayed to reduce the amount of $NO_x$ emission exhausted from the engine.

It is to be noted that, though the flow control valve 11 in the first embodiment of the invention is directly actuated by the diaphragm 13 through the rod 14, the diaphragm 13 in the diaphragm unit 15 may be connected to a modified flow control valve to be operated by means of a solenoid through a mechanical-electrical conversion means which converts the movement of the diaphragm 13 into an electrical signal to be supplied to the solenoid of the modified flow control valve. Also, if the flow control valve is changed into a type to be operated by means of a solenoid, the flow control valve 11 may be arranged to actuate directly by the signal of the control unit 20 for detecting the engine accelerating range without the arrangement of the diaphragm unit 15 disclosed in the above embodiment.

Reference is now had to FIG. 2 which shows a second embodiment of the invention in which provides a pair of first and second recirculation lines 10*a*′ and 10*a*″ for exhaust gases each associated with a flow control valve 11′ or 11″, diaphragm unit 15′ or 15″ and control unit 20′ or 20″, a portion of the exhaust gases discharged from engine 6 into the exhaust pipe 9 being taken off from the exhaust pipe 9 by a take-off line 10*c* and supplied from the take-off line into the intake ends 10*a*′ and 10*a*″ of the first recirculation line 10*a*′ and second recirculation line 10*a*″, respectively, both separated from each other and connected to separate branch lines defined by take-off line 10*c*.

The first recirculation line 10*a*′ comprises said first take-off line 10*a*′ and a first intake line 10*b*′ of which the delivery end opens into a portion of carburetor 1 which is between upstream of the throttle valve 5 and downstream of the venturi section 3 with a difference from that of the first embodiment of the invention. Flow of exhaust gases along the first recirculation line 10*a*′ may be throttled or completely stopped by a first flow control valve 11′ which is actuated by a first diaphragm unit 15′ provided with a first control fluid duct 17′ for introducing a negative pressure or the atmospheric pressure to actuate the first diaphragm unit 15′ through a first three-way solenoid-operated valve 19′ of which the solenoid may be actuated by a signal from a first control unit 20′ including a clutch-actuation detecting device 21′ and a timer means 23′. Also, the second recirculation line comprises said second take-off line 10*a*″ and a second intake line 10*b*″ of which the delivery end opens into a portion of carburetor 1 which is between downstream of the throttle valve 5 above an engine intake manifold as same as that of the first embodiment of the invention. Flow of exhaust gases along the second recirculation line 10*a*″ may be throttled or completely stopped by a second flow control valve 11″ which is actuated by a second diaphragm unit 15″ provided with a second control fluid duct 17″ for introducing a negative pressure or atmospheric pressure to actuate the second diaphragm unit 15′ through a second three-way solenoid-operated valve 19″ of which solenoid may be actuated by a signal from a second control unit 20″ including an engine-cooling-condition detecting device 30. The first and second flow control valves 11′ and 11″, the first and second diaphragm units 15′ and 15″, and the first and second three-way solenoid-operated valves 19′ and 19″ have by themselves the same constructions and functions as those of the flow control valve 11, the diaphragm unit 15, and the three-way solenoid-operated valve 19 of the first embodiment of FIG. 1, respectively, so that the explanation thereof may be abbreviated. Also, the clutch-actuation detecting device 21' and timer means 23' of the first control unit 20' have the same construction and functions as those of the clutch-actuation detecting device 21 and timer means 23 of the first embodiment of FIG. 1, respectively. However, in the second embodiment, the take-out ends of the first and second control fluid ducts 17' and 17" for introducing a negative pressure into the first and second diaphragm unit 15' and 15" are respectively connected to a portion of the carburetor 1 which is above the completely closed position of the throttle valve 5 to be traversed by the edge of the throttle valve 5 as it moves open, and is below the opened position of the throttle valve 5 which is opened to the extent over a predetermined value, whereby the negative pressure existing below the throttle valve 5 to be opened at a degree of opening larger than the predetermined value in the engine accelerating range may be introduced into the first and second control fluid ducts 17' and 17". In other words, the arrangement of the first and second control fluid ducts 17' and 17" in connection with the throttle valve 5 of the carburetor 1 may act in a place of and the same operation of the throttle valve-opening detecting device 22 of the control unit 20 in the first embodiment. The engine -cooling-condition detecting device 30 of the second control unit 20" is, for instance, a thermoelectric switch which is provided to detect the temperature of cooling water circulating into the engine and actuated such that, when the engine 6 is starting and idling under the temperature of cooling water lower than a predetermined value as an engine-cooling-condition, the switch is found closing to supply an output signal to the solenoid of the second three-way solenoid-operated valve 19" which is actuated to locate at the air bleed position, and, after the engine is warming up and cruising in a normal condition with cooling water of high temperature, the switch is turned opening without signal, resulting in that the second three-way solenoid-operated valve 19" is changed over from the air bleed position to the EGR position. It is to be noted that the diameter of the pipe employed in the first recirculation line 10a' may be designed to be larger than that of the pipe of the second recirculation line 10a", whereby the exhaust gases may be discharged into the carburetor 1 with a rate of the large amount to a portion upstream of the throttle valve 5.

With the above-mentioned arrangement of the exhaust gas recirculation apparatus according to the second embodiment of the invention, the exhaust gases of the engine 6 are recirculated through the first and second recirculation lines 10a' and 10a" from the exhaust pipe 9 and take-off line 10c into two portions of the carburetor 1 which are upstream and downstream of the throttle valve 5, said first and second recirculation lines 10a' and 10a" being respectively controlled to open or close by means of said control units 20' and 20" through said diaphragm units 15' and 15" and three-way solenoid-operated valves 19' and 19".

If now the engine 6 is started in a condition of engine-cooling at the temperature of cooling water lower than a predetermined value, the engine-cooling-condition detecting device 30 of the second control unit 20" is always actuated to place the second three-way solenoid-operated valve 19" at the air bleed position, resulting in that the second diaphragm unit 15" is not actuated to open the flow control valve 11" and no recirculation of exhaust gases will occur in the second recirculation line 10" until the temperature of cooling water raises up to the extent over the predetermined value. When the engine 6 is warming up with the temperature of cooling water higher than the predetermined value and, at the same time, if the vehicle is accelerated by the driver pushing the accelerator pedal forward to open the throttle valve 5 to a position which is above the take-out end of the second control fluid duct 17" with the throttle valve 5 opening to the extent over the predetermined value, the engine-cooling-condition detecting device 30 of the second control unit 20' is controlled to change over the second three-way solenoid-operated valve 19" from the air bleed position to the EGR position, resulting in that the negative pressure existing at a portion of the carburetor 1 below the throttle valve 5 is introduced into and actuates the second diaphragm unit 15" to open the second flow control valve 11" and recirculation of exhaust gases in the second recirculation line 10" will occur until the throttle valve 5 is closed to a position below the take-out end of the second control fluid duct 17" or widely opened to the extent effective to eliminate, below the throttle valve 5, the negative pressure large enough to actuate the second diaphragm unit 15' as mentioned above. In addition, when the vehicle is accelerated by the driver pushing the clutch pedal and the accelerator pedal together, the clutch-actuation detecting device 21' is actuated to supply a signal to the timer means 23' of the first control unit 20' which, in turn, actuates the first three-way solenoid-operated valve 19' to change-over from the air bleed position to the EGR position thereof, resulting in that the negative pressure existing at a portion of the carburetor 1 below the throttle valve 5, which is opened to a position above the take-out end of the first control fluid 17', is introduced into and actuates the first diaphragm unit 15' to open the first flow control valve 11', through which exhaust gases from engine 6 will recirculate in the first recirculation line 10a' and discharge from the delivery end of the first recirculation line 10a' into a portion of carburetor 1 until the presetting period of the timer means 23' is terminated, as the same manner as mentioned in the first embodiment of the invention.

Accordingly, in all of the above described embodiments of the invention, there is advantageously presented an exhaust gas recirculation apparatus for an internal combustion engine comprising a flow control valve provided in a recirculation line connecting the exhaust pipe to a portion of carburetor, and a control unit to be actuated in the engine accelerating range for setting up the opening period of the control valve in such a manner that the control valve will open upon receipt of signals from a clutch-actuation detecting device and a throttle valve-opening detecting device, both of which can automatically detect the engine acceleration, and will keep its opening for a presetting period of a timer means which can selectively establish a period necessary to recirculate, from the beginning of the engine acceleration, the exhaust gases into a carburetor in order to reduce the amount of $NO_x$ emission in the exhaust gases to be discharged from the engine. Therefore, the reduction of $NO_x$ emission for exhaust gases of engine will be effectively obtained by the apparatus of the invention which is simple in construction and accurate in functioning, and can be readily incorporated into an exhaust line of various combustion engines at low cost.

Although the present invention has been fully described by way of example with reference to the attached drawings, it is to be noted that various changes and modifications are apparent to those skilled in the art. Therefore, unlss otherwise such changes and modifications depart from the scope of the present invention, they should be construed as included therein.

What is claimed is:

1. An exhaust gas recirculating apparatus for an internal combustion engine provided with a transmission to be operated by a clutch and having a throttle valve controlling flow through a carburetor induction passage and a duct connecting the exhaust gases to the engine intake manifold with a flow control valve normally closing the duct to prevent recirculation and movable to an open position by a signal applied thereto, comprising a device for detecting the actuation of said clutch, a device for detecting the opening of said throttle valve to be reached to the extent above a predetermined degree of opening, and a timer to be actuated for a presetting period, said flow control valve being moved to open by signals from both of said devices and kept opening by signal from said timer.

2. An exhaust gas recirculating apparatus as defined in claim 1, wherein said clutch-actuation detection device comprises a switch to be actuated by a clutch pedal.

3. An exhaust gas recirculation apparatus as defined in claim 1, wherein said throttle valve-opening detection device comprises a pipe which detects negative pressure existing downstream of the throttle valve opened to the extent over the predetermined degree.

4. An exhaust gas recirculating apparatus as defined in claim 1, wherein the delivery end of said duct is opened downstream of the throttle valve.

5. An exhaust gas recirculating apparatus as defined in claim 1, wherein the delivery end of said duct is opened upstream of the throttle valve.

6. An exhaust gas recirculating apparatus as defined in claim 1, wherein there is further provided with a device for controlling the air-fuel ratio in the carburetor which is connected to and actuated by the signal from said timer.

7. An exhaust gas recirculating apparatus as defined in claim 1, wherein there is further provided with a device for automatically adjusting the ignition point of an ignition means within the engine which is connected to and actuated by the signal from said timer.

8. An exhaust gas recirculating apparatus for an internal combustion engine provided with a transmission to be operated by a clutch and having a throttle valve controlling flow through a carburetor induction passage and a duct connecting the exhaust gases to the engine intake manifold with a flow control valve normally closing the duct to prevent recirculation and movable to an open position by an external force applied thereto, comprising a diaphragm unit including a diaphragm which divides said diaphragm unit into a constant pressure chamber and a negative pressure chamber and which is connected to and controls the position of said flow control valve, spring means exerting on said diaphragm a force which acts constantly to cause said diaphragm to move said flow control valve to a closed position and is opposed by a force resulting from the difference of pressure in said chambers and a duct connecting said negative pressure chamber to a negative pressure source, a stop valve which is provided on said duct of the diaphragm unit, and a control means including a device for detecting the actuation of said clutch, a device for detecting the opening of said throttle valve to be reached to the extent above a predetermined degree of opening, and a timer to be actuated for a presetting period, said control means controlling said stop valve in such that said stop valve is opened to introduce negative pressure into said negative pressure chamber of the diaphragm unit by signals from both of said devices and is kept opening by the signal from said timer.

9. An exhaust gas recirculating apparatus for an internal combustion engine provided with a transmission to be operated by a clutch and having a throttle valve controlling flow through a carburetor induction passage and a pair of first and second ducts each connecting the exhaust gases to the engine intake manifold with a flow control valve normally closing the duct to prevent recirculation and movable to an open position by an external force applied thereto, comprising first and second diaphragm units each including a diaphragm which divides said diaphragm unit into a constant pressure chamber and a negative pressure chamber and which is connected to and controls the position of said flow control valve, spring means exerting on said diaphragm a force which acts constantly to cause said diaphragm to move said flow control valve to a closed position and is opposed by a force resulting from the difference of pressure in said chambers and a duct connecting said negative pressure chamber to a negative pressure source and provided with a stop valve thereon, a first control means including a device for detecting the actuation of said clutch, a device for detecting the opening of said throttle valve to be reached to the extent above a predetermined degree of opening, and a timer to be actuated for a presetting period, said first control means controlling said first stop valve in such that said first stop valve is opened to introduce negative presure into said negative pressure chamber of the first diaphragm unit by signals from both of said two devices and is kept opening by the signal from said timer, and a second control means including a device for detecting the temperature of cooling water circulating into the engine, said second control means controlling said second stop valve in such that said second stop valve is opened to introduce negative pressure into said negative pressure chamber of the second diaphragm unit in a condition of non-existing the signal from said last mentioned device.

* * * * *